United States Patent [19]

Carpenter et al.

[11] Patent Number: 5,026,468

[45] Date of Patent: Jun. 25, 1991

[54] DUAL BED CATHODIC PROTECTION SYSTEM WITH AUTOMATIC CONTROLS

[75] Inventors: Ronald L. Carpenter; Craig E. Yates; Robert G. Morris, all of Beaver, Okla.

[73] Assignee: Colorado Interstate Gas Company, Colorado Springs, Colo.

[21] Appl. No.: 354,835

[22] Filed: May 22, 1989

[51] Int. Cl.[5] ..... C23F 13/00

[52] U.S. Cl. ..... 204/196; 136/291; 204/147; 204/148; 204/197

[58] Field of Search ..... 204/147, 148, 196, 197

[56] References Cited

U.S. PATENT DOCUMENTS

| | | | |
|---|---|---|---|
| 2,752,308 | 6/1956 | Andrus | 204/196 |
| 2,864,750 | 12/1958 | Hughes et al. | 204/149 |
| 3,201,335 | 8/1965 | MacNab et al. | 204/147 |
| 3,349,017 | 10/1967 | Ziegler | 204/196 |
| 3,612,898 | 10/1971 | Doniguian et al. | 204/196 |
| 4,136,309 | 1/1979 | Galberth et al. | 204/196 |
| 4,592,818 | 6/1986 | Cavil et al. | 204/147 |

*Primary Examiner*—T. Tung

*Attorney, Agent, or Firm*—Phillip A. Rein

[57] ABSTRACT

This invention relates to a dual bed cathodic protection system with automatic controls and method of use utilizing an impressed cathodic protection anode assembly powered through a solar power supply in conjunction with a sacrificial cathodic protection anode assembly which is known in the prior art to use a corrosion element to emit the necessary electrical current to protect a structure assembly from the effects of corrosion. The dual bed cathodic protection system with automatic controls includes (1) a solar power supply to receive sun power from a solar panel; (2) a ground bed assembly which may either be a deep well or surface type; (3) a system automatic control assembly operable to control selected use of either an impressed or sacrificial protection anode assembly; and (4) a protected structure buried within the ground to receive an electrical current to prevent corrosion thereto.

8 Claims, 4 Drawing Sheets

DUAL BED CATHODIC PROTECTION SYSTEM WITH AUTOMATIC CONTROLS

| Patent No. | Invention | Inventor |
|---|---|---|
| 3,612,898 | PULSED CATHODIC PROTECTION APPARATUS AND METHOD | Doniguian et al |
| 3,696,365 | CATHODIC PROTECTION SYSTEM | Charles F. Ward |
| 4,136,309 | POWER OUTPUT CONTROL CIRCUIT FOR SOLAR-POWERED CATHODIC PROTECTION SYSTEM | Calberth et al |
| 4,351,703 | CATHODIC PROTECTION MONITORING | Joseph D. Winslow, Jr. |
| 4,413,679 | WELLBORE CATHODIC PROTECTION | Thomas K. Perkins |
| 4,495,990 | APPARATUS FOR PASSING ELECTRICAL CURRENT THROUGH AN UNDERGROUND FORMATION | Titus et al |
| 4,561,949 | APPARATUS AND METHOD FOR PREVENTING ACTIVITY LOSS FROM ELECTRODES DURING SHUTDOWN | Miles et al |
| 4,588,022 | ANODIC PROTECTION SYSTEM AND METHOD | Delio Sanz |
| 4,592,818 | CATHODIC PROTECTION SYSTEM | Cavil et al |

It is noted that numerous patents were found related to cathodic protection systems but none disclose a combination of utilizing an impressed cathodic protection anode bed and a sacrificial cathodic protection anode bed.

The Doniguian et al patent discloses a cathodic protection apparatus and method utilizing a D.C. power source plus having a new and novel control circuit.

The Ward patent discloses a cathodic protection system having a mechanical signaling device to indicate system failure.

The Calberth et al patent is drawn to a control circuit utilizing solar power with storage batteries.

The Winslow, Jr. patent discloses a cathodic protection monitoring system which utilizes a plurality of spaced specimens along the length of the pipe which are monitored to maintain the proper protective cathodic current.

The Perkins patent is drawn to a wellbore cathodic protection system for oil well drilling in the Arctic region where permafrost being highly resistive is a problem in obtaining such cathodic protection.

The Titus et al patent is drawn to an apparatus for passing electrical current through an underground formation and, more specifically, to a new and novel anode structure.

The Sanz patent is drawn to an anodic protection system utilized in heat exchangers for cooling sulfuric acid.

None of the above U.S. patents describe a structure nor function similar to the applicant's invention as described hereinafter.

PRIOR ART HISTORY

A cathodic protection system is known in the prior art and utilizes a D.C. energy voltage and current of proper polarity and intensity being applied to a metallic surface which is then forced to serve as a cathode on a closed electrical operation of a purposely constructed electrolytic cell. Cathodic protection is achieved by the application of the D.C. energy and the nature of the source of the required D.C. energy has no significant influence on the system's effectiveness. The power source can be a conventional electrical source which may be generated by oil, gas, coal, or nuclear power means but some of these sources have become expensive to operate and, of course, not available in certain remote locations.

A cathodic protection system mainly consists of (1) special electrodes installed in the electrolyte or ground surface in soil or water and these are called anodes or anode ground bed; (2) a source of D.C. energy which may be a separate electrical device or special anodes such as a galvanic anode which may be an impressed cathodic protection anode or a sacrificial cathodic protection anode; (3) the structure to be protected is normally buried within the ground such as oil and gas pipes, water well pipes, bridge structures, and such structures served as a cathode of the purposely constructed electrolytic cell; (4) a continuous electrolyte to convey electrical voltage and current from the anode to the cathode (structure to be protected); and (5) a metallic circuit which provides an electrical coupling of the proper polarity between the components of the cathodic protection system.

The galvanic anode system is a major portion of the cathodic protection system and a sacrificial cathodic protection anode is one which deteriorates while it requires no external power energy source to achieve its driving electrical potential.

The impressed current system in a cathodic protection system is limited in voltage and current only by their design ratings but an external energy source is required and in our invention we are utilizing a power supply to the impressed current system to provide the cathodic protection and then switching to the sacrificial cathodic protection system when the external power source, i.e. solar power, is not available.

PREFERRED EMBODIMENT OF THE INVENTION

In one preferred embodiment of this invention, a dual bed cathodic protection system with automatic controls and method of use is operable to utilize a solar power supply with a cathodic protection system to protect a buried structure from corrosion without requiring an external electrical power supply. The object of the cathodic protection system is to establish and maintain electrical chemical condition at the metallic surface of the item to be protected which is in contact with a continuous electrolyte such as soil and water which counteracts the anodic effects of a normal electrochemical corrosion process. In the dual bed cathodic protection system with automatic controls of this invention, it is noted that either a deep well ground bed assembly or a shallow surface ground bed assembly may be utilized, each having (1) an impressed cathodic protection anode assembly; and (2) a sacrificial cathodic protection anode assembly and both connected to a system automatic control assembly. The impressed cathodic protection anode assembly is provided with a plurality of impressed anode members which are buried in the ground and surrounded by a suitable backfill material (coke breeze) and separated by an insulation material (pea gravel) placed between the impressed anode members and the sacrificial cathodic protection anode assembly. The sacrificial cathodic protection anode assembly includes a plurality of sacrificial anode members which are surrounded by a backfill material (bentonite); separated by the insulation material from the impressed cathodic protection anode assembly; and connected to the system automatic control assembly. The system automatic control assembly includes a plurality of control circuit members to indicate the status of the system which is all interconnected by an electrical control circuit. The electrical control circuit is operable to receive electrical power generated through solar panels which are automatically controlled when sunlight is available to activate a control relay and present cathodic protection between the impressed cathodic protection anode assembly and the normal buried structure being protected. On receiving a decrease in voltage from the solar power supply, the control relay is deactivated to automatically transfer the protection to the buried structure being achieved from the sacrificial cathodic protection anode assembly. Conversely, it is noted that on achieving sunlight and sun rays to the solar power supply, the system automatic control assembly operates to again switch the protection system from the sacrificial cathodic protection anode assembly to the impressed cathodic protection anode assembly. Another embodiment of this invention utilizes a plurality of solar panels in the solar panel assembly so as to provide a dual bed of sacrificial cathodic protection anode assemblies, one of each associated with a respective protected structure assembly. This embodiment is operable to provide dual structure protection with the use of a single impressed cathodic protection anode assembly and a pair of sacrificial cathodic protection anode assemblies. In the case of dual structures being protected, a separate dual structure electrical control circuit is provided in order to achieve new, and novel automatic controls.

OBJECTS OF THE INVENTION

One object of this invention is to provide a dual bed cathodic protection system with automatic controls utilizing an impressed cathodic protection anode assembly and a sacrificial cathodic protection anode assembly and having a system automatic control assembly to switch from one protection assembly to the other when so required.

One further object of this invention is to provide a dual bed cathodic protection system with automatic controls and method of use utilizing an impressed cathodic protection anode assembly which is supplied with an external power source through a solar power supply and having an automatic control assembly to automatically switch from (1) solar power supply to the impressed cathodic protection anode assembly at the proper current and voltage condition to the (2) sacrificial cathodic protection anode assembly to provide continuous protection to the structure being protected.

One other object of this invention is to provide a dual bed cathodic protection system with automatic controls providing protection through a sacrificial cathodic protection anode assembly but, when solar power is available, switching the protection system to an impressed cathodic protection anode assembly to provide complete cathodic protection to a structure being protected without requiring an external power source and maintaining the proper requirement of voltage and amperage conditions.

Still, one further object of this invention is to provide a dual bed cathodic protection system with automatic controls which can be utilized with a single impressed cathodic protection anode assembly energized and operated by a solar power supply and having a plurality of sacrificial cathodic protection anode assemblies, each associated with a separate underground structure to be protected.

Still, one other object of this invention is to provide a dual bed cathodic protection system with automatic controls not requiring an external power source but being self-supporting; substantially maintenance free; economical to operate; and reliable and dependable in operation.

Various other objects, advantages, and features of the invention will become apparent to those skilled in the art from the following discussion, taken in conjunction with the accompanying drawings, in which:

FIGURES OF THE INVENTION

Figure 1:
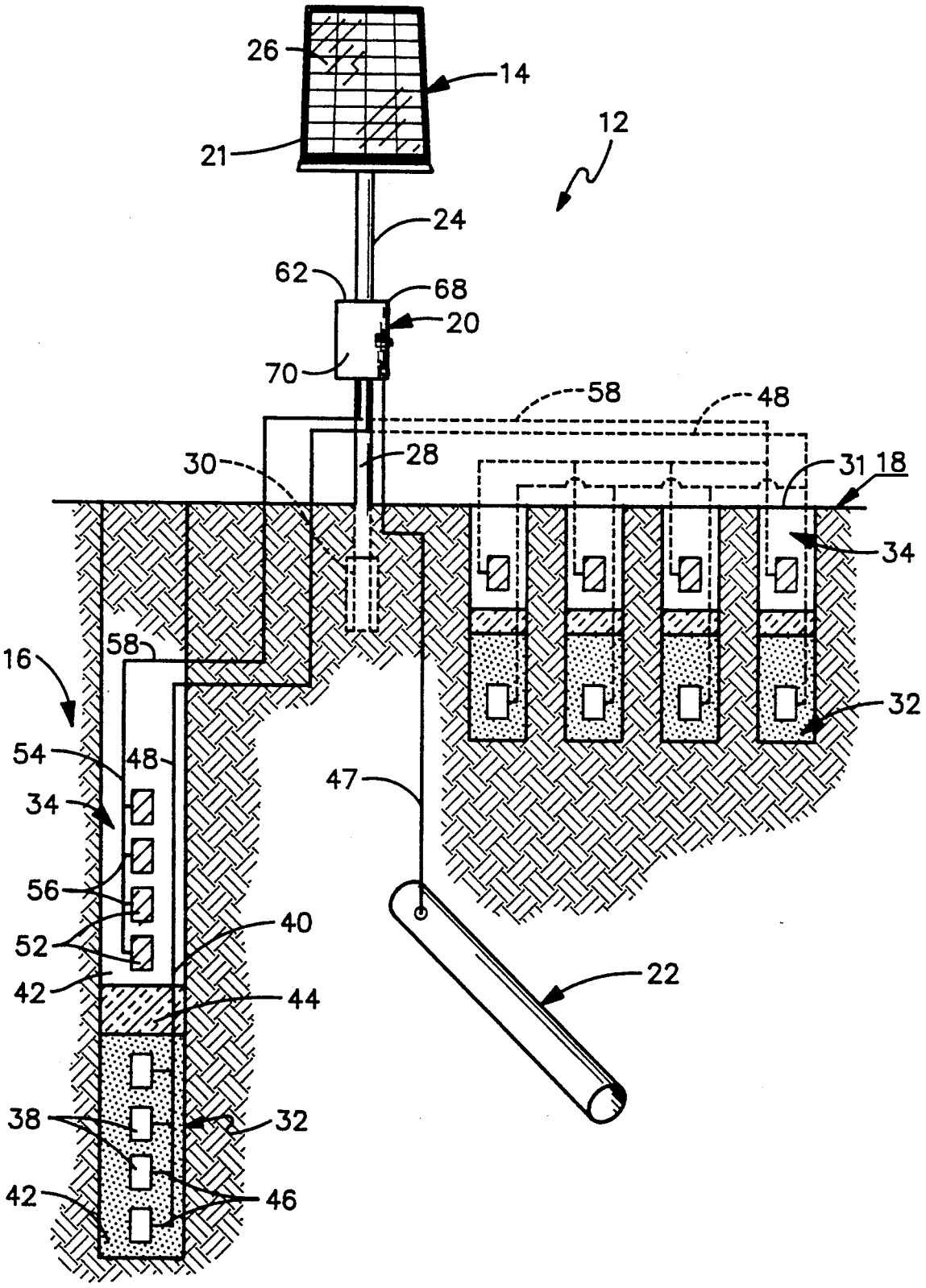
FIG. 1 is a schematic diagram of the dual bed cathodic protection system with automatic controls of this invention utilizing either a deep well ground bed assembly or a shallow surface ground bed assembly to provide cathodic protection to a buried structure.

The following is a discussion and description of preferred embodiments of the dual bed cathodic protection system with automatic controls of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail and, in particular to FIG. 1, a dual bed cathodic protection system with automatic controls of this invention, indicated generally at 12, includes (1) a solar power supply 14; (2) a deep well ground assembly 16 or a surface/shallow ground bed assembly 18; (3) a system automatic control assembly or sensing means 20; and (4) a protected structure assembly or metallic object 22. The solar power supply 14 includes a solar panel assembly 21 mounted on a panel support assembly 24.

The solar panel assembly 21 includes a solar panel member 26 of a generally conventional nature operable to be directed normally in a southerly direction to receive the maximum amount of sun rays thereon in order to generate electrical output therefrom.

The panel support assembly 24 includes an upright support pole 28 inserted through a ground surface 31 and secured to a base anchor support 30.

The deep well ground bed assembly 16 is illustrated as positioned below the ground surface 31 at a depth to be in a permanent moisture condition and includes (1) an impressed cathodic protection anode assembly or means 32; and (2) a sacrificial cathodic protection anode assembly or means 34. The impressed cathodic protection anode assembly 32 is known in the prior art and supplied with an impressed current or through a rectifier system through the use of an energy source such as electricity, wind power, fuels, or solar power. The use of a solar powered impressed cathodic protection anode system is known in the art but such systems are either (1) utilized with batteries which entail a large initial investment expense and maintenance; or (2) the solar power unit only affords corrosion protection when sun light is available and, therefore, no protection when sunlight is not available which is not a desirable end result.

The impressed cathodic protection anode assembly 32 includes (1) a plurality (illustrated as four) of adjacent but spaced impressed anode members 38; (2) an impressed anode connector assembly 40; (3) a backfill material 42 enclosing the impressed anode members 38; and (4) an insulation material 44 to electrically separate the impressed cathodic protection anode assembly 32 from the sacrificial cathodic protection anode assembly 34.

It has been found that the use of a coke breeze material as the backfill material 42 and pea gravel as the insulation material 44 achieves the best results.

The impressed anode connector assembly 40 is provided with electrical connector lines 46 interconnected to each of the impressed anode members 38 and then connected to a main common line 48 connected to the system automatic control assembly 20.

The sacrificial cathodic protection anode assembly 34 is of a galvanic type or gravity flow cathodic protection system utilizing a corrosive material that is less noble than the systems to be protected and is specifically known as a corrosion cell where corrosion occurs to provide the cathodic protection. The sacrificial cathodic protection anode assembly 34 includes (1) a plurality (illustrated as four) of spaced sacrificial anode members 52; and (2) a sacrificial anode connector assembly 54 which is connected to the system automatic control assembly 20.

The sacrificial anode connector assembly 54 includes a plurality of connector line sections 56 interconnecting the anode members 52 to a main common line section 58 which electrically connects same to the system automatic control assembly 20. Additionally, a backfill material 42 preferably of a bentonite material is used to surround the sacrificial anode members 52 and the insulation material 44 being pea gravel is used to electrically insulate same from the impressed cathodic protection anode assembly 32.

A wire 47 connects the system automatic control assembly 20 to the protected structure assembly 22. As noted in FIGS. 1 and 3, the deep well ground bed assembly 16 can be replaced with a surface shallow ground bed assembly 18 which provides the same end result and function but is placed within 8 feet to a maximum of 20 feet in depth below the ground surface 31. The surface shallow ground bed assembly 18 includes the previously described impressed cathodic protection anode assembly 32 and the sacrificial cathodic protection anode assembly 34.

The system automatic control assembly 20 includes (1) a control cabinet member 62; (2) a plurality of controlled circuit members 64 mounted within the control cabinet member 62; (3) an electrical control circuit or first and second connecting means 66 to interconnect the elements of the control circuit member 64 to the solar power supply 14 of the deep well ground assembly 16; and (4) a dual structure electrical control circuit or first and second connecting means 67 utilized similarly to the electrical control circuit 66 except utilized with a plurality of solar panel members and a plurality of protected structure assemblies as will be explained.

The control cabinet member 62 includes a generally box member 68 having a lid member 70 pivotally connected to one upright edge thereof and held in a closed condition by conventional latch type structures to lock same for security purposes.

Figure 5:
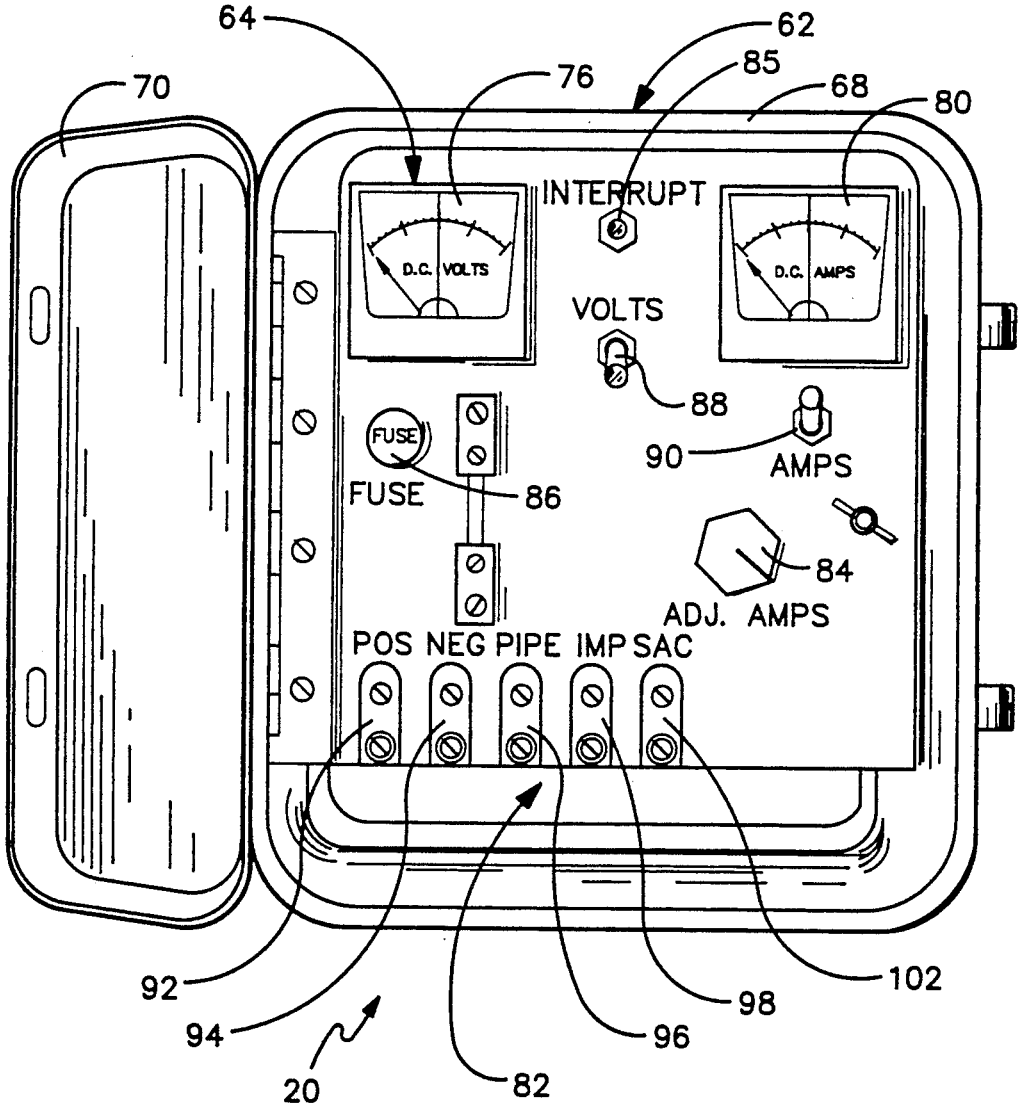
FIG. 5 is a front elevational view of a system automatic control assembly of the dual bed cathodic protection system with automatic controls.

As noted in FIG. 5, the control circuit members 64 mounted within the box member 68 include (1) a volt meter member 76; (2) an amp meter member 80; (3) a plurality of connector terminal blocks 82; (4) amperage adjustment member 84; (5) an interrupt switch 85; and (6) a fuse container member 86.

The volt meter member 76 utilizes a volt meter switch 88 to periodically check the D.C. voltage as being applied to the system either through the impressed cathodic protection anode assembly 32 or the sacrificial cathodic protection anode assembly 34.

The amp meter member 80 is controlled though an amp meter switch 90 which is also utilized to periodically measure the amperage being obtained and utilized through the impressed cathodic protection anode assembly 32 and the sacrificial cathodic protection anode assembly 34.

The terminal blocks 82 include (1) a positive block 92 which is connected from the solar power supply 14; (2) a negative block 94 connected to the negative pole of the solar power supply 14; (3) a pipe block 96 to be connected to the structure assembly 22 being protected; (4) an impressed bed block 98 being connected to the impressed cathodic protection anode assembly 32; and (5) a sacrificial bed block 102 which is connected to the sacrificial cathodic protection anode assembly 34. The amperage adjustment member 84 is operable to selectively control the amperage supply to the system as will be noted.

The interrupt switch 85 is operable to disconnect the solar power supply 14 from the system automatic control assembly 20 so that the output from the sacrificial bed, more particularly, the sacrificial cathodic protection anode assembly 34, can be tested during daylight hours.

The volt meter member 76 and the amp meter member 80 can be eliminated with the test points provided so that a portable hand held meter can be used for periodic voltage and amperage measurements.

The fuse member 86 is operable in a conventional manner to prevent overload conditions to the electrical control circuits 66 or 67 due to malfunction of the solar power supply 14.

Figure 2:
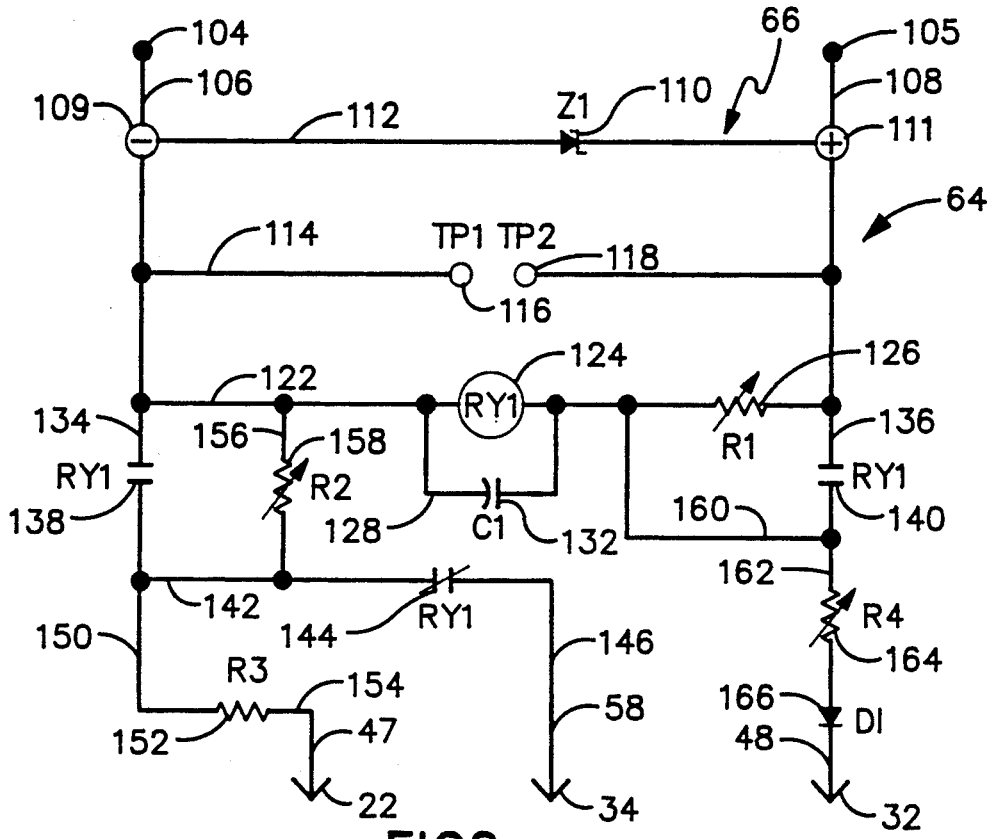
FIG. 2 is an electrical schematic diagram of an electrical control circuit used to protect the dual bed cathodic protection system with automatic controls as illustrated in FIG. 1.

As noted in FIG. 2, the electrical control circuit 66 includes solar panel power inlet terminals 104 of a negative input and 105 of a positive input which is indicated in lines 106, 108 respectively. A line 112 between lines 106, 108 and between terminals 109, 111 has a zener diode 110 (Z1) connected therein. The zener diode 110 is placed across the output of the solar panels between terminals 109, 111 to control the output voltage. The zener diode 110 operates to achieve a constant voltage of a predetermined or consistent output of the system.

A line 114 is connected between power inlet lines 106, 108 and each respectively connected in a test point terminal 116, 118. The test point terminals 116, 118 are connected to the volt meter member 76 and volt meter switch 88 so as to periodically, as desired, read the output voltage in power inlet lines 106, 108 to assure that the system is within desirable operating limits in regard to voltage.

A line 122 is interconnected between the power inlet lines 106, 108 having a relay member or coupling means 124 (RY1) and a resistor 126 (R1) connected therebetween in series. The relay 124 is of a 12-volt double pole, double throw type but the relay voltage can vary depending on a particular application.

The resistor or adjustable resistance means 126 (R1) is utilized as, when the sun rises and the voltage increases from the solar power supply 14, the voltage drops across the resistor 126 (R1). This voltage drop allows a higher than normal voltage to be reached by the solar power supply 14 before the relay 124 (RY1) is energized.

A line 128 is connected on opposite sides of the relay 124 (RY1) and having a capacitor 132 (C1) mounted therein. The capacitor 132 stores electrical energy and allows the overall system to operate smoothly on energizing and de-energizing the relay 124 (RY1) without chatter of the contact points therein.

Lines 134, 136 are respectfully connected to the power inlet lines 106, 108 and being interconnected through normally opened relay contact points (RY1) indicated at 138, 140 respectively.

A line 142 is connected on the output side of the relay contact 138 and extended through a normally closed relay contact 144 of the relay 124 (RY1). It is then connected through a line 146 to the sacrificial cathodic protection anode assembly 34.

A line 150 is connected to the junction of line 142 and 134 which is a continuation of the power line 106. The line 150 is connected through a resistor 152 (R3) and line 154 to the protected structure assembly 22. The resistor 152 (R3) is a calibrated shunt resistor which allows current measurement without breaking the circuit and interrupting protection to the protected structure assembly 22.

A line 156 is interconnected between lines 122 and 142 and having a resistor 158 (R2) mounted therein. The resistor 158 (R2) allows a small amount of current to pass around the normally open contacts 138, 140 when the condition of the rising sun puts a voltage on the solar power supply 14. The resistor 158 (R2) then slowly loads the impressed cathodic protection anode assembly 32 before the relay 124 (RY1) is energized. This combination of resistors or first adjustable resistance means 126 (R1) and 158 (R2) work together to aid the entire system in working in a smoother manner and prevents shattering of the contacts of the relay 124 (RY1). It is found through research and development that, if the resistors 126 (R1) and 158 (R2) are not used, the entire system may energize and then kick off because of voltage drop caused by loading the system all at once. By dropping the voltage across the resistor 126 (R1), this allows the solar power supply 14 to have an extra power boost to keep the relay 124 (RY1) energized.

A line 160 is interconnected between lines 122, 136 and bypasses the resistor 126 (R1) and the normally open relay contact 140 (RY1). The line 160 allows the resistor 126 (R1) to be bypassed when the relay 124 (RY1) is energized to allow the full solar power supply 14 to be placed across the relay 124 (RY1) to prevent the chattering of the electrical contacts therein due to low voltage being applied to the coil of the relay 124 (RY1).

A line 162 is connected to a juncture of the output of relay contact 140 (RY1) and line 160 and is trained in series through a resistor 164 (R4), and a diode or diode means 166 (D1) and connected to the impressed cathodic protection anode assembly 32 which, collectively, is known as a circuit by-pass means. The resistor 164 (R4) is of an adjustable type and used to regulate the voltage and current output of the impressed cathodic protection anode assembly 32 which is powered through the solar power supply 14. This allows the operator of the entire dual bed cathodic protection system with automatic controls 12 of this invention to meet the specific needs of the protected structure assembly 22 in light of the prevalent soil conditions.

The diode 166 (D1) is of a type used on a low energized system and is operable to prevent the relay 124 (RY1) from being re-energized by the voltage difference of the sacrificial and impressed ground beds after the solar panel voltage is low enough to de-energize the system. There may be a voltage difference between the impressed and sacrificial ground cathodic protection anode assemblies 32, 34 being sufficient enough to keep the relay 124 (RY1) energized. The diode 166 (D1) allows the relay 124 (RY1) to de-energize by blocking the flow of current from the sacrificial cathodic protection anode assembly 24 to the impressed cathodic protection anode assembly 32.

Figure 4:
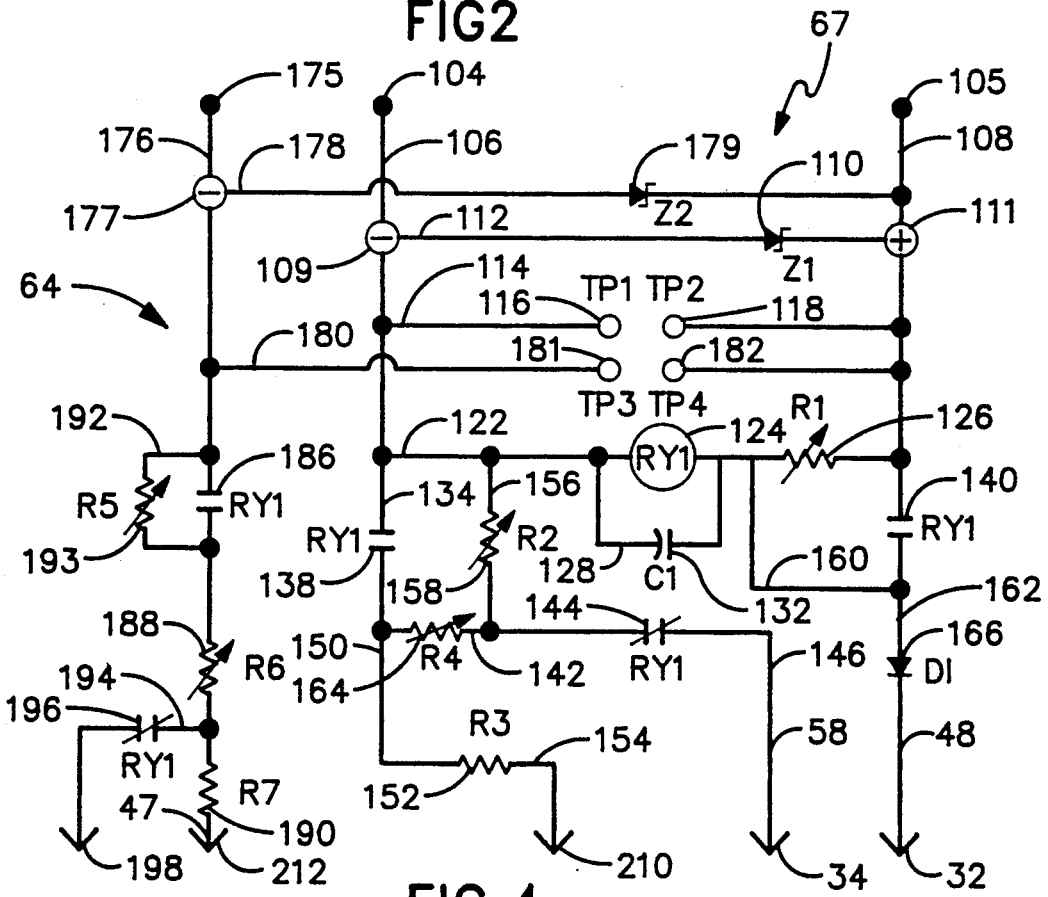
FIG. 4 is an electrical schematic diagram of an electrical control circuit utilized with the second embodiment as illustrated in in FIG. 3.
Figure 3:
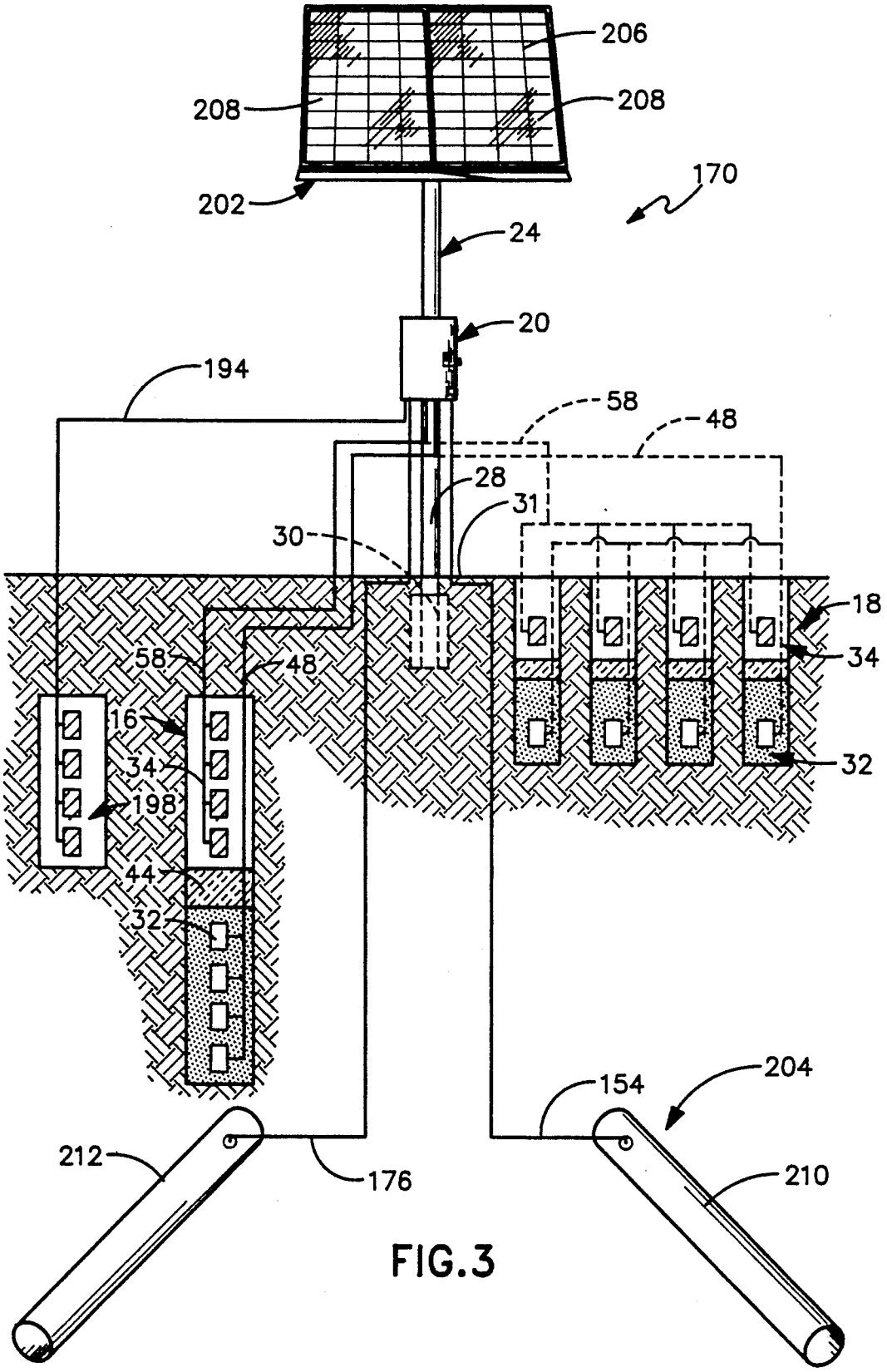
FIG. 3 is a view similar to FIG. 1 illustrating a second embodiment of a dual bed and multiple protected structure cathodic protection system with automatic controls utilizing either a deep well or a shallow surface ground bed assembly to provide protection to a plurality of buried structures.

In another embodiment of this invention, as generally indicated in FIGS. 3 and 4, a dual bed multiple protected structure cathode protection system with automatic controls 170 of this invention is utilized with the dual structure electrical control circuit 67. The dual structure electrical control circuit 67 is similar to the electrical control 66 except utilizing (1) a pair of structures to be protected; and (2) a pair of sacrificial cathodic protection anode assemblies as will be explained.

As noted in FIG. 4 as to the electrical schematic of this second embodiment, we utilize the solar panel power inlet terminals 104, 105 which are connected respectively to the power inlet lines 106, 108 and, in turn, to the terminals 109, 111. The elements leading from the inlet terminals 104, 105 are identical to those described in electrical control circuit 66 except line 154 leads to a second protected structure as will be described. The previously described elements featured are used being the zener diode 110 (Z1); test point terminals 116, 118; relay 124 (RY1); resistor 126 (R1); capacitor 132 (C1); normally closed contacts 144 (RY1); shunt resistor 152 (R3); resistor 158 (R2); resistor 164 (R4); and diode 166 (D1) which are respectfully interconnected to the impressed cathodic protection anode assembly 32 and the sacrificial cathodic protection anode assembly 34.

The new electrical components of the dual structure electrical control circuit 67 are illustrated on the left side of FIG. 4 and include an inlet power terminal 175 connected to a second one of the solar panels being utilized as will be described. This panel power inlet line 176 is of a negative nature as noted by terminal 177.

A line 178 is connected to the power inlet line 108 and through a zener diode 179 (Z2) mounted therein. The zenier diode 179 (Z2) is connected to the second solar panel, as will be noted, to control the output voltage and achieve constant voltage of a predetermined level.

A line 180 is connected between the power inlet line 176 and the positive power inlet line 108 and having test points 181, 182 mounted therein. The test points 181, 182 are selectively connected to the volt meter member 76 (or contacted by a hand held meter for voltage measurements) and controlled through the volt meter switch 88 to present a voltage reading to check the voltage system in regard to the output of the second solar panel. The panel power inlet line 176 is then connected in series to a normally open relay contact 186 (RY1) from the relay 124 (RY1); an adjustable resistor 188 (R6); and a shunt resistor 190 (R7) which is connected to the second structure to be protected as will be noted.

A line 192 is connected to the power inlet line 176; bypasses the normally open relay contact 186 (RY1); and having a resistor 193 (R5) mounted therein; and connected again to the power inlet line 176. This aids in slowly loading the system before the relay 124 (RY1) is energized just as resistor 158 does with protection of the single structure system being the protected structure assembly 22.

A line 194 is connected through the resistors 188 (R6) and 190 (R7) through a normally closed relay contact 196 (RY1); and connected to a second sacrificial cathodic protection anode assembly 198. The second sacrificial cathodic protection anode assembly 198 is indentical in structure to the previously described sacrificial cathodic protection anode assembly 34 as one such sacrificial bed is needed for each of the buried structures being protected.

As noted in FIG. 3, the dual bed and multiple protected structure cathodic protection system with automatic controls in 170 includes (1) a dual solar power supply 202; (2) the deep well ground bed assembly 16 or the surface shallow ground bed assembly 18; (3) the system automatic control assembly 20; and (4) a dual protected structure assembly 204.

The dual solar power supply 202 is similar to the solar power supply 14 except having a solar panel assembly 206 supported on the panel support assembly 24 as previously described. The solar panel assembly 206 is provided with a pair of solar panel members 208 which are substantially identical in structure and operation to that previously described for the solar panel member 26.

The system automatic control assembly 20 for the second embodiment has been described with the dual structure electrical control circuit 67 utilized therewith.

The dual protected structure assembly 204 is provided with a first protected member 210 and a second protected member 212. It is obvious that numerous types of structures to be protected can be utilized with the requirement being a separate solar panel member 208 for each structure being protected and, additionally, with a sacrificial cathodic protection anode assembly 34 or 198 for each structure being protected. A single impressed cathodic protection anode assembly 32 can be used to protect numerous structures with a sacrificial cathodic protection anode assembly 34 needed for each protected structure.

USE AND OPERATION OF THE INVENTION

In regard to the basic operation of the system as noted in the electrical schematic of FIG. 2, the system utilizes two separate ground beds in conjunction with a solar power supply to provide protection through an impressed ground bed system during daylight or sunlight hours and a sacrificial ground bed system during non-sunlight hours which does not require an external power source. The benefit of this invention is to provide 24-hour protection regardless of sunlight conditions and allowing the impressed ground bed system to revitalize during non-sunlight hours.

In the use and operation of the dual bed cathodic protection system with automatic controls 12 of this invention, it is noted in FIG. 1 that the system is operable either with the deep well ground bed assembly 16 or the surface shallow ground bed assembly 18. The choice of the system is normally dependent on the ground conditions as there has to be a soil condition with moisture or other such conditions so as to provide an electrical transmission from the impressed cathodic protection anode assembly 32 or the sacrificial cathodic protection anode assembly 34 to the protected structure assembly 22. Therefore, the choice between the deep well ground bed assembly 16 or the surface shallow ground bed assembly 18 is dependent on the soil conditions and determined at the time of installation.

The solar power supply 14 is secured to the soil beneath the ground surface 31 in a secure manner and having the solar panel member 26 directed normally in a southerly direction at a desired angle to receive the maximum benefit of the sun as it is passing over the site location. The amount of protection to be afforded to the protected structure 22 is determined by soil conditions; the type of protective coating placed on the protected structure assembly 22; and the strength and availability of solar power to the solar panel member 26. Additional solar panel members 26 can be added to the system to increase the solar power output. Similarly, increasing the number of sacrificial anode members 52 will increase the output of the sacrificial cathodic protection anode assembly 34.

The dual bed cathodic protection system with automatic controls 12 of this invention is basically operable whereupon the relay 124 (RY1) is not energized and cathodic protection is achieved with current flow from the sacrificial cathodic protection anode assembly 34 to the protected structure assembly 22 through the normally closed contacts 144 (RY1) of the relay 124 (RY1).

As the sun rises, the voltage on the solar power supply 14 increases and, when reaching a predetermined level, the relay 124 (RY1) will energize and the normally opened relay contacts 138, 140 will close and the normally closed contact 144 will open thereby providing for cathodic protection of the structure assembly 22 through the impressed cathodic protection anode assembly 32. It has been found that this basic system utilizing the impressed cathodic protection anode assembly 32 and sacrificial cathodic protection anode assembly 34, on being controlled by the relay 124 (RY1), is operable to provide the protection needed to the structure assembly 22.

Although the system will operate with a minimum amount of elements, the additional improvement to the system in function and operation has been achieved by the use of additions of the resistors 126 (R1) and 158 (R2). These resistors 126 (R1), 158 (R2) act to allow a small amount of current around the normally opened contacts 136, 140 of the relay 124 (RY1) when the rising sun puts its voltage on the solar panel member 26. This slowly loads the impressed cathodic protection anode assembly 32 before the relay 124 (RY1) is energized. The resistors 126 (R1) and 158 (R2) operate together to help the system energize smoothly and prevent a clicking or chattering of the contact points of the relay 124 (RY1) due to perhaps a marginal operating voltage applied to the solenoid of the relay 124 (RY1) which would happen if the resistors 126 (R1) and 158 (R2) were not utilized.

The zener diodes 110 (Z1) and 179 (Z2) are placed across the respective outputs of the solar panels 26 or 208 to control the output voltage and achieves a constant voltage at a predetermined level for a consistent output of the overall system. The resistors 164 (R4) and 188 (R6) are operable to regulate the output of the impressed cathodic protection anode assembly 32 to the protected structures 210 and 212.

The test point terminals 116, 118, 181, and 182 are operable to selectively connect to the volt meter member 76 (or the hand held meter) to check the voltage as achieved from the respective solar panel members 26 or 208 depending on the system being utilized.

METHOD OF OPERATION

In the method of utilizing the dual bed cathodic protection system with automatic controls 12 of this invention, it is noted that the system is installed as shown in FIG. 1 with the steps being (1) obtaining a power source through the use of the sun being applied to the solar panel member 26; (2) transferring the incoming electrical power supply through the system automatic control assembly 20 outwardly to the impressed cathodic protection anode assembly 32; (3) transferring an electrical positive output pole therein to a negative pole being the protected structure assembly 22; (4) sensing a decrease in the amount of sun power on the solar panel member 26 and de-energizing a relay 124 (RY1) within the system automatic control assembly 20; (5) de-energization of the relay 124 (RY1) operates to switch the output generated electric power from the impressed cathodic protection anode assembly 32 to output from the sacrificial cathodic protection anode assembly 34 which protects the structure assembly 22 during non-sunlight hours; and (6) on sensing input solar energy to the solar panel member 26, the relay 124 (RY1) is energized thus placing the impressed cathodic protection anode assembly 32 back into the system utilizing solar power to protect the structure assembly 22.

Further, the method of use of the dual bed and multiple protected structure cathodic protection system with automatic controls 170 utilized the further steps of (1) providing a pair of sacrificial cathodic protection anode assemblies 34, 198; and (2) protecting a pair of structures 210, 212.

The dual bed cathodic protection system with automatic controls of this invention is operable to utilize the impressed cathodic protection anode assembly 32 which can be powered by various means such as electrical power, fuel, windmills, or more specifically in our case, the use of a solar power supply which provides economical, substantially maintenance free power being utilized as a D.C. power supply.

The dual bed cathodic protection system with automatic controls is operable with either a deep well ground bed assembly or a surface shallow ground assembly which is utilized depending on the depth of the structure to be protected and the surrounding soil conditions.

The dual bed cathodic protection system with automatic controls of this invention is operable to use a sacrificial cathodic protection anode assembly which requires no external power and an impressed cathodic protection anode assembly utilizing the power of the sun. The use of solar power alone is not satisfactory as no protection is achieved to the structure being protected when (1) the sunlight is not available; and (2) after sunset and before sunrise. This combination system is especially beneficial as the use of a sacrificial cathodic protection anode assembly is variable in output and would have to be replaced twice as often if not utilizing the solar power impressed cathodic protection anode assembly of this invention.

The other systems utilizing solar power having a battery system are very expensive in initial cost; have substantial maintenance problems requiring skilled personnel; and do not achieve a cost effective benefit or function of the invention described herein.

The dual bed cathodic protection system with automatic controls of this invention is relatively economic in initial cost investment; reliable in operation in automatically switching from a sacrificial cathodic protection mode to the sun powered protection mode; and substantially maintenance free compared to prior art structures.

While the invention has been described in conjunction with preferred embodiments thereof, it will be understood that this description is intended to illustrate and not to limit the scope of the invention, which is defined by the following claims:

We claim:

1. A cathodic protection system for a metallic structure buried in the earth, the system comprising:

an impressed anode assembly buried in the earth in proximity with said metallic structure;

a sacrificial anode assembly buried in the earth in proximity with said metallic structure;

a solar power source for providing an output voltage that increases with increasing intensity of sunlight incident thereon and that decreases with decreasing intensity of the sunlight incident thereon;

first connecting means, powered solely by said solar power source, operative for selectively connecting and disconnecting said sacrificial anode assembly with said metallic structure;

second connecting means, powered solely by said solar power source, operative for selectively connecting and disconnecting said solar power source between said impressed anode assembly and said metallic structure; and sensing means, coupled to said solar power source and to said first and second connecting means, for sensing the output voltage of said solar power source, said sensing means being operative, upon sensing that the output voltage of said solar power source has fallen below a predetermined level, for causing said first connecting means to connect said metallic structure to said sacrificial anode assembly and for causing said second connecting means to disconnect said solar power source from said metallic structure and said impressed anode assembly, said sensing means being further operative, upon sensing that the output voltage of said solar power source has risen above said predetermined level, for causing said first connecting means to disconnect said metallic structure from said sacrificial anode assembly and for causing said second connecting means to connect said solar power source to said metallic structure and said impressed anode assembly.

2. A cathodic protection system for a metallic structure buried in the earth as in claim 1 wherein said sensing means comprises an electromagnetic relay having an actuator coil for receiving the output voltage provided by said solar power source as a sole source of operating power for said electromagnetic relay.

3. A cathodic protection system for a metallic structure buried in the earth as in claim 2 further comprising adjustable resistance means serially connected with said coil for setting said predetermined level.

4. A cathodic protection system for a metallic structure buried in the earth as in claim 1 further comprising:

circuit by-pass means, connected across said second connecting means, for causing the increasing output voltage provided by said solar power source to be applied to said impressed anode assembly means while said sacrificial anode assembly remains connected to said metallic structure by said first connecting means; and diode means connected in series between said circuit by-pass means and said impressed anode assembly, said diode means being polarized to permit a flow of current from said solar power source but blocking a flow of current from said sacrificial anode assembly.

5. A cathodic protection system for a plurality of metallic structures buried in the earth, the system comprising:

an single impressed anode assembly buried in the earth in proximity with said plurality of metallic structures;

a plurality of sacrificial anode assemblies buried in the earth in proximity with said plurality of metallic structures, each one of said plurality of sacrificial anode assemblies being associated with a different one of said plurality of metallic structures;

a solar power source for providing an output voltage that increases with increasing intensity of sunlight incident thereon and that decreases with decreasing intensity of the sunlight incident thereon;

first connecting means, powered solely by said solar power source, operative for selectively connecting and disconnecting each of said plurality of sacrificial anode assemblies with the associated one of said plurality of metallic structures;

second connecting means, powered solely by said solar power source, operative for selectively connecting and disconnecting said solar power source between said single impressed anode assembly and each of said plurality of metallic structures; and sensing means, coupled to said solar power source and to said first and second connecting means, for sensing the output voltage of said solar power source, said sensing means being operative, upon sensing that the output voltage of said solar power source has fallen below a predetermined level, for causing said first connecting means to connect each one of said plurality of metallic structures to the associated one of said plurality of sacrificial anode assemblies and for causing said second connecting means to disconnect said solar power source from each one of said plurality of metallic structures and said single impressed anode assembly, said sensing means being further operative, upon sensing that the output voltage of said solar power source has risen above said predetermined level, for causing said first connecting means to disconnect each one of said plurality of metallic structures from the associated one of said plurality of sacrificial anode assemblies and for causing said second connecting means to connect said solar power source to each one of said plurality of metallic structures and said single impressed anode assembly.

6. A cathodic protection system for a plurality of metallic structures buried in the earth as in claim 5 wherein said solar power source comprises a plurality of solar panels, each of which is associated with a different one of said plurality of metallic structures.

7. A cathodic protection system for a metallic structure buried in the earth, the system comprising:

a ground bed assembly buried in the earth, said ground bed assembly comprising an impressed anode assembly and a sacrificial anode assembly, each operatively associated with the metallic structure;

a solar power source for providing an output voltage that increases with increasing intensity of sunlight incident thereon and that decreases with decreasing intensity of the sunlight incident thereon; and a system automatic control assembly, coupled to said solar power source and to said ground bed assembly, said system automatic control assembly being powered solely by said solar power source and being generally operative for selectively controlling said impressed anode assembly and said sacrificial anode assembly, said system automatic control assembly being specifically operative for connecting the output voltage provide by said solar power source to said impressed anode assembly during periods of time when sunlight is incident on said solar power source.

8. A cathodic protection system for a metallic structure buried in the earth as in claim 7 wherein said system automatic control assembly is operative for automatically switching from operation of said impressed anode assembly to operation of said sacrificial anode assembly during periods of time when no sunlight is incident on said solar power source.

* * * * *